US007804402B2

(12) United States Patent
Lang et al.

(10) Patent No.: US 7,804,402 B2
(45) Date of Patent: Sep. 28, 2010

(54) FIRE DETECTORS WITH ENVIRONMENTAL DATA INPUT

(75) Inventors: Scott R. Lang, Geneva, IL (US); Timothy A. Rauworth, West Chicago, IL (US)

(73) Assignee: Honeywell International Inc., Morristown, NJ (US)

( * ) Notice: Subject to any disclaimer, the term of this patent is extended or adjusted under 35 U.S.C. 154(b) by 358 days.

(21) Appl. No.: 11/627,417

(22) Filed: Jan. 26, 2007

(65) Prior Publication Data

US 2008/0180258 A1 Jul. 31, 2008

(51) Int. Cl.
*G08B 19/00* (2006.01)

(52) U.S. Cl. ..... 340/522; 340/506; 340/521

(58) Field of Classification Search ..... 340/522, 340/506, 524, 521, 539.22, 825.36, 825.49
See application file for complete search history.

(56) References Cited

U.S. PATENT DOCUMENTS

| | | | | |
|---|---|---|---|---|
| 3,827,012 | A * | 7/1974 | Duggan | 337/320 |
| 4,871,999 | A | 10/1989 | Ishii et al. | |
| 4,975,684 | A | 12/1990 | Guttinger et al. | |
| 5,400,246 | A * | 3/1995 | Wilson et al. | 700/17 |
| 5,451,929 | A | 9/1995 | Adelman et al. | |
| 5,483,222 | A | 1/1996 | Tice | |
| 5,659,292 | A | 8/1997 | Tice | |
| 6,249,220 | B1 | 6/2001 | Kaji et al. | |
| 7,068,177 | B2 | 6/2006 | Tice | |
| 2004/0189461 | A1 | 9/2004 | Tice | |
| 2006/0119477 | A1 | 6/2006 | Tice | |
| 2006/0181407 | A1 | 8/2006 | Tice | |

FOREIGN PATENT DOCUMENTS

| | | |
|---|---|---|
| DE | 296 18 242 | 11/1996 |
| EP | 1124210 A1 | 8/2001 |
| GB | 2299668 | 10/1996 |

OTHER PUBLICATIONS

System Sensor, Filtrex: A Smoke Detector for Difficult Environments Applications Guide, published 2002.
System Sensor, Filtrex Intelligent Photoelectric Smoke Detector Installation and Maintenance Instructions, published 2005.
Siemens FirePrint Detector Specifications and Brochure, published May 2006.
International Search Report for PCT/US 08/51487, dated May 20, 2008 (2 pages).

* cited by examiner

*Primary Examiner*—Daryl Pope
(74) *Attorney, Agent, or Firm*—Husch Blackwell Sanders Welsh & Katz

(57) ABSTRACT

Regional physical information can be entered along with automatically sensed ambient condition information into regional monitoring system. Alarm decision processing can be adjusted in accordance therewith.

16 Claims, 4 Drawing Sheets

FIRE DETECTORS WITH ENVIRONMENTAL DATA INPUT

FIELD

The invention pertains to regional monitoring and alarm systems. More particularly, the invention pertains to such systems which automatically respond to environmental characteristics throughout the region to adjust an alarm detection process.

BACKGROUND

Various methods are known for combining signals from different types of sensors in order to distinguish fires from nuisance conditions. These multicriteria detectors are intended to sense the earliest fire products in order to achieve a quick and accurate response. Representative forms of processing are disclosed in each of Lee D. Tice, Fire Detection System and Method Using Multiple Sensors, US 2006/0119477 A1, Jun. 8, 2006; Lee D. Tice, Multi-Sensor Device and Methods for Fire Detection, US 2006/0181407 A1, Aug. 17, 2006; Lee D. Tice, Multi-Sensor Device and Methods for Fire Detection, US 2004/0189461 A1, Sep. 30, 2004; Lee D. Tice, Multiple Sensor Apparatus and Method, U.S. Pat. No. 5,483,222, Jan. 9, 1996; Lee D. Tice, Apparatus Including a Fire Sensor and a Non-Fire Sensor, U.S. Pat. No. 5,659,292, Aug. 19, 1997; Lee D. Tice, Multi-Sensor Device and Methods for Fire Detection, U.S. Pat. No. 7,068,177 B2, Jun. 27, 2006, assigned to the assignee hereof and incorporated by reference.

Currently, in known systems, end-users can only select a detector sensitivity (or in rare cases specify descriptive labels, such as "lobby"). End-users are often not well equipped to properly select a sensitivity for a given space.

In addition, performance based codes are becoming more prevalent. Performance based codes provide placement of detectors based on system performance goals (such as building occupants evacuated in 60 seconds) rather than prescriptive requirements (such as one detector every 30 feet). As the change is made to performance based codes, fire detection systems that support detectors that are aware of their environment will become more valuable.

It has also been recognized that when smoke detectors are positioned in a high airflow area (such as near a vent), their response can be delayed or entirely disabled. Furthermore, other ambient conditions can make false alarms more likely (c.f. shower steam).

There is thus an on-going need to be able to incorporate environmental information into alarm decision processing so as to enhance performance and to improve reliability. It would be preferable if such information could be acquired and updated, automatically, to the greatest extent possible while the system is carrying out normal processing.

DETAILED DESCRIPTION

Figure 1:
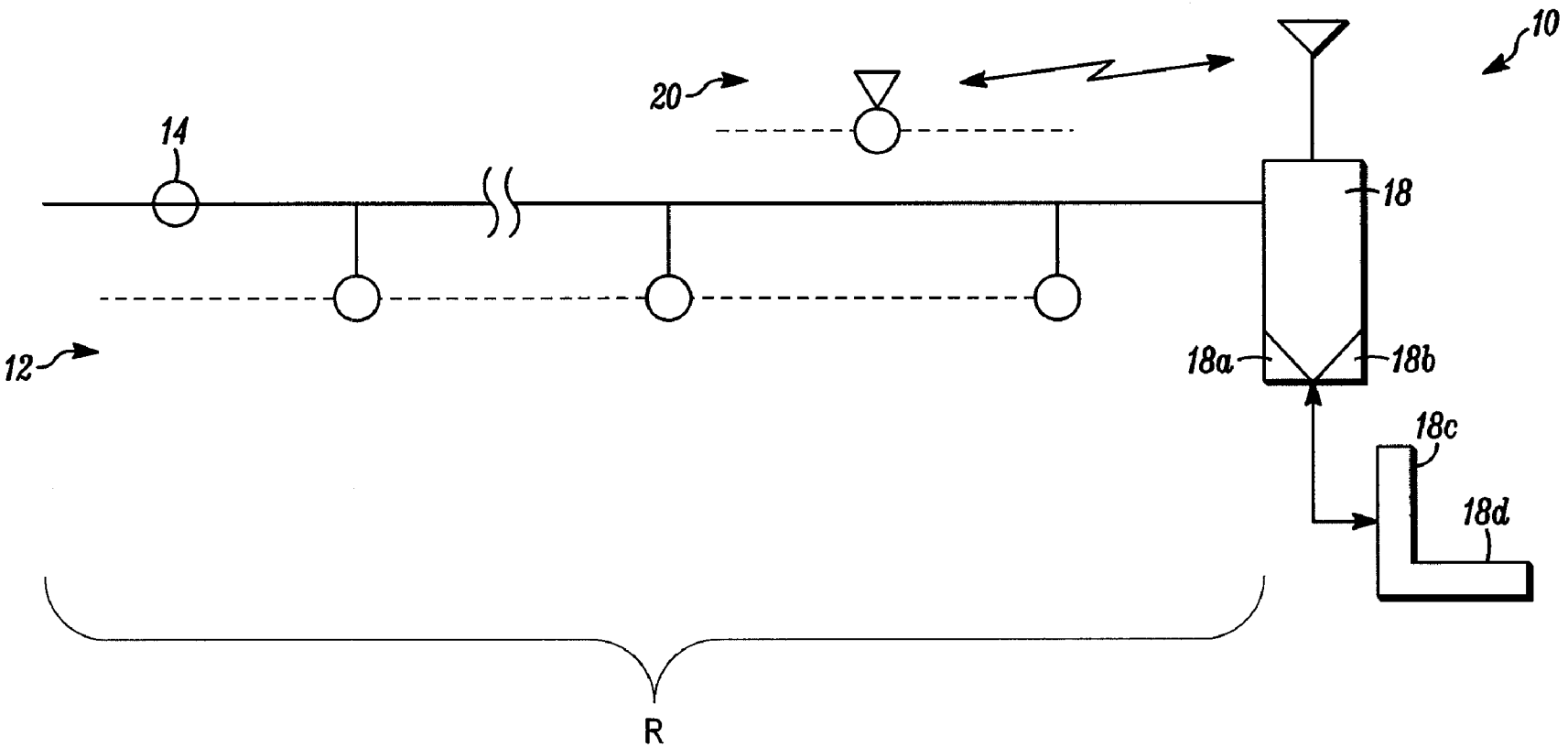
FIG. 1 is an alarm system which embodies the invention.

While embodiments of this invention can take many different forms, specific embodiments thereof are shown in the drawings and will be described herein in detail with the understanding that the present disclosure is to be considered as an exemplification of the principles of the invention, as well as the best mode of practicing same, and is not intended to limit the invention to the specific embodiment illustrated.

Embodiments of the invention function to optimize alarm decision processing methods before a fire breaks out. Data can be entered manually that describes the space (context) in which the detectors reside. Data can also be gathered by the detectors themselves and acted upon directly or in processed form. The alarm decision methods could be adjusted based on patterns of prior conditions or a fixed set of prior conditions Data could be processed at the detector(s) or at the system control panel. Detection processing commonly takes place in both the detector(s) and the system control unit, or, panel. Embodiments of this invention thus include methods for increasing the speed and accuracy in the detection of fire using fire detectors in combination with additional environmental information.

In one aspect of the invention, fire detection is implemented using two new methods. First, the fire alarm system—either the detector or the control panel—will provide for the input of initial conditions about the space that is being protected. Typically, detectors are set to one of several sensitivities throughout a building based on an educated guess on the part of the system designer. In accordance with the invention, a system designer will input the dimensions of the room or space and other parameters important to the development of a fire. These parameters will be factored into the alarm decision processing along with the amount of smoke that is sensed. Second, the fire detectors can use inputs from a multisensor arrangement to optimize the sensing of fire. Typically, multicriteria detectors use different sensors to sense the various fire products. In accordance with the invention, the multiple detectors can be used to adjust the detection processing before occurrence of a fire.

In some known fire alarm control units, or panels, there are user interfaces that show maps of the protected premises. This same information can be used as an input to the alarm decision processing. For example, a higher ceiling may warrant higher sensitivity. Higher airflow (as in a hallway) may warrant greater smoothing. This represents additional information, provided by the user or installer, on which to base an alarm decision.

The detector(s) can also provide important information before the fire. If the detector(s) sense abnormally high temperatures at the ceiling, there may be greater stratification and sensitivity may need to be increased. Perhaps the detector will sense increased $CO_2$. That may mean that the likelihood of fire is lessened. An increase in $O_2$ may mean greater propensity for fire—or a hotter fire. Detection can be optimized based on information gathered before the fire—possibly even hours, days, or weeks in advance. This information can be provided manually by the user or automatically acquired by the detectors themselves.

Exemplary Manually Input Information

- Use building floor plan as manual input data (ceiling height, room length, width)
  - Info is already input into some fire alarm control panels to aid responding firefighters Expected temperature
Typical air changes
Is the space on an outside wall?
Is there natural light in the space?
Fuel load—furnishings, chemicals, etc.
Type of occupancy?
Expected use of space?
Type of HVAC?
  Heat: electric (resistive), natural gas, hot water
Exemplary Automatically Sensed Information
Sensors could be co-located or remote from one another
Airflow
  Could use the dual thermistors on detector
  Could adjust detector sensitivity based on airflow
    Higher sensitivity with high airflow
    More drift compensation with high airflow
    More smoothing with high airflow
  Could generate a trouble condition with excessive airflow
Absolute temperature in room at ceiling
  Possible pre-stratification information
  Is high temperature (120 F) indicative of no occupants?
  Is temperature trend information a proxy for occupancy
Temperature delta between two heights in room
  Pre-stratification information
  Could be done with two beam detectors at different heights
    Could IR be used for temperature detection?
Occupancy
  High $CO_2$ indicator of occupancy?
Cleanliness (number of dust particles)
  Could be done with a photo chamber
Increased hazard
  Increased level of oxygen?
  Flammable gases
Visible light
  Day/night adjustment from outside light
  Occupancy based on artificial lighting
Humidity
Sound
  Indicator of occupancy?
Are building utilities being used?
  Phone, electric, gas, water usage to indicate occupancy?

In another aspect of the invention, ambient sensors (flow, temperature, humidity) can be added to a smoke detector to monitor the ambient environment for out-of-specification conditions. This would allow the smoke detector to signal a trouble condition, or take other actions to prevent non-operation or false alarm.

Smoke detectors or thermal detectors often include heat sensing thermistors to provide an additional type of fire indicating output. Thermistors can be configured as airflow sensors. With software and circuitry in accordance with the invention, the thermistors can be pulsed at higher power, raising their temperature. The rate of cooling can be correlated with the rate of airflow. The smoke detector can check airflow at either random or periodic intervals to assess whether it is installed in too high an airflow area, and signal the condition either locally, or at the control panel.

Duct smoke detectors require a minimum airflow to operate. By adding an airflow responsive thermistor to a duct detector, it is possible to detect and to signal a trouble condition when insufficient airflow is present. Insufficient airflow could be caused by a filter loaded with dust, and needing maintenance, providing an obstruction. Such conditions could be sensed with one or more local thermistors to then generate an environmentally based trouble indicating signal.

Humidity/condensation sensors can be added to a smoke detector to signal a poor placement condition (c.f. near a stove, bathroom, or other steam source) locally or at the control panel.

FIG. 1 illustrates a system 10 which embodies the present invention. The system 10 incorporates a plurality of detectors 12 which are, via a medium 14 in communication with a fire alarm control unit 18. Detectors 12 can be different and unlike one another. They include one or more ambient condition sensors of smoke, temperature, flame and the like all without limitation. They can also incorporate one or more gas sensors.

Medium 14 can be implemented as a wired or wireless medium all without limitation. Wirelessly coupled detectors, illustrated by a plurality of detectors 20 could be in, for example, RF communication with the control unit 18.

Detectors 12, 20, representative examples, which have been illustrated in previously noted published patent applications and issued patents assigned to the assignee and incorporated by reference herein, are illustrated in FIG. 1 installed in and monitoring a region R. The region R could be a single story region or a multiple story region all without limitation.

The alarm control unit 18 can include one or more programmable processors 18*a* as well as executable software 18*b*. Control unit 18 can include a graphical display device 18*c* and a manually operable input device, for example a keyboard 18*d*.

Those of skill will also understand that while conventionally one or more fire alarm control units, such as the control unit 18 would be located adjacent to or within a portion of the region R, those units could be at least in part displaced from the region R and in communication with the detectors 12, 20 via one or more computer networks such as the Internet.

Those of skill in the art will understand that the detectors of the pluralities 12, 20 could each include one or more programmable processors and associated software for carrying out various aspects of alarm processing. Some or all of the alarm processing could be carried out in control unit 18. Neither the exact location nor the precise form of alarm processing represents limitations of the present invention.

Figure 2:
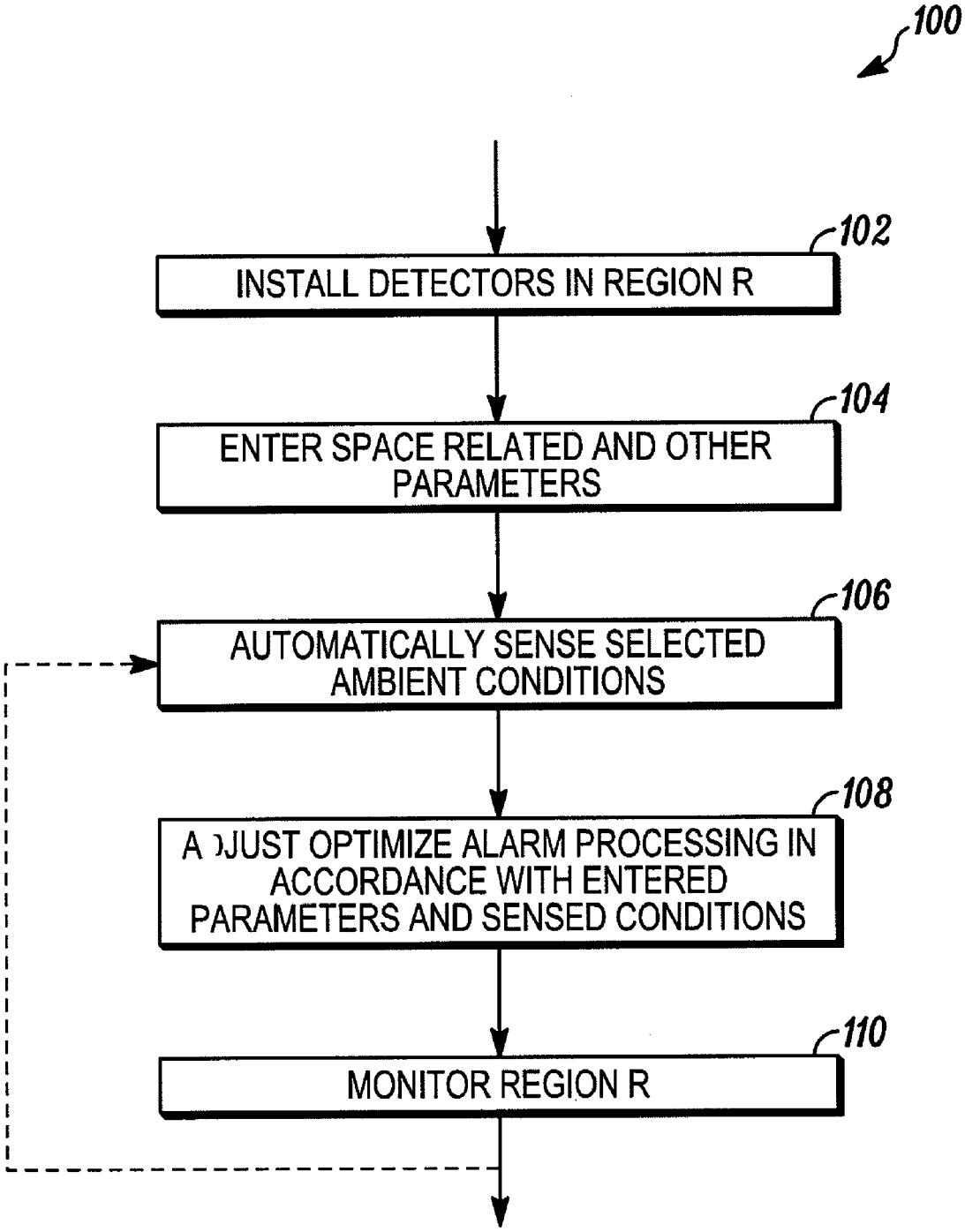
FIG. 2 is a flow diagram of processing in accordance with the invention.

FIG. 2 is a flow diagram of processing 100 in accordance with the invention. Initially the detectors are installed in the region R, 102. Space related and other parameters can be manually entered into the system 10, 104. Selected ambient conditions can be automatically sensed 106.

The alarm processing can be adjusted or optimized in accordance with the entered parameters and sensed conditions, 108. The region can then be monitored 110 on an ongoing basis. It will be understood that the automatic sensing can be periodically reinitiated to carry out further adjustments and optimization of the alarm processing 108 in real-time. The region monitoring 110 can then be reinitiated.

The results of modifying alarm processing could also be displayed on device 18*c* for use by an operator. Regional characteristics can be manually entered by an operator via keyboard 18*d*.

Those of skill in the art will understand that the types of processing disclosed above and in the various published applications and issued patents incorporated herein by reference are representative and illustrative only. Other forms of alarm processing can be utilized in accordance with the invention where such are susceptible to being adjusted and optimized in accordance with the space related parameters as well as the automatically sensed ambient conditions as noted above.

Figure 3:
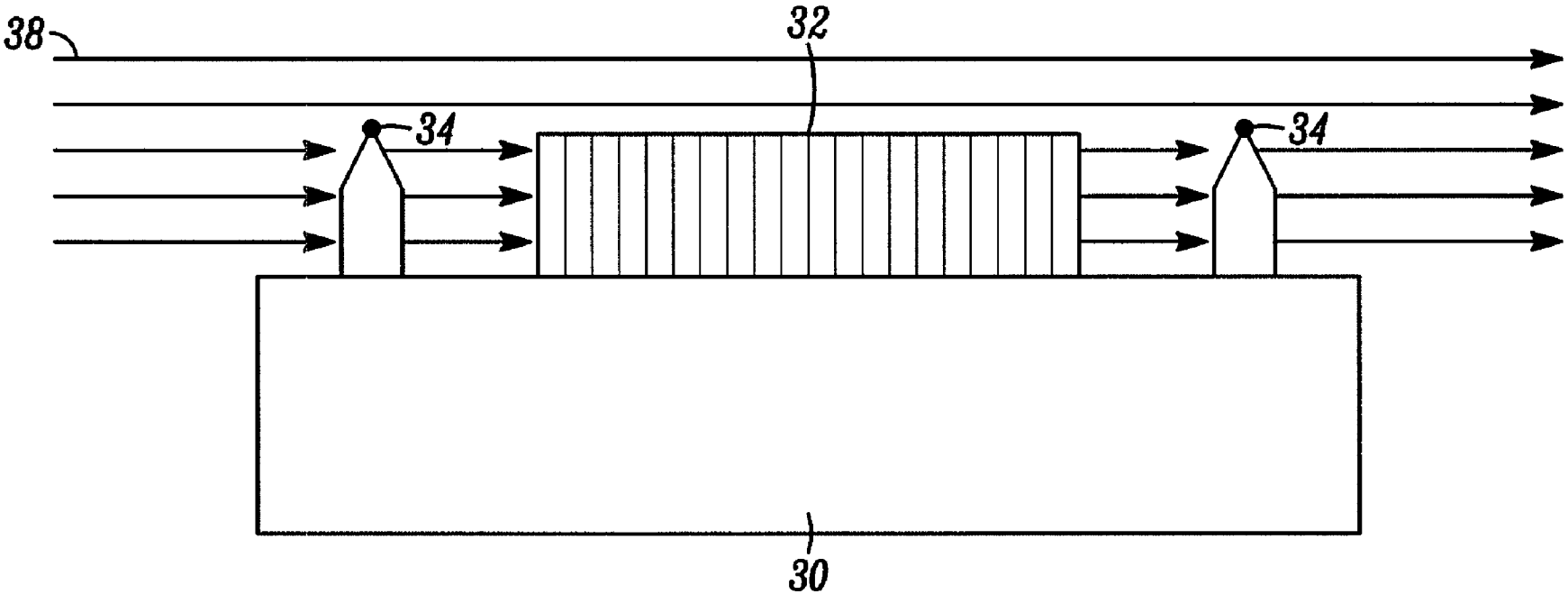
FIG. 3 is a diagram illustrating aspects of a detector in accordance with the invention.

FIG. 3 illustrates an exemplary smoke detector 30 of a type that might be incorporated into the pluralities 12, 20 discussed previously. Detector 30 incorporates a smoke sensing chamber 32 and one or more thermistors 34. The thermistors 34 are oriented so as to be exposed to ambient airflow 38, from the region adjacent to the respective detector 30 which may or may not contain smoke.

As those of skill in the art understand, smoke detectors, such as the detector 30, require a range of airflows to operate correctly. If the airflow is too low or too high, the respective detector may not respond correctly. For example, a detector installed near a vent may not respond to smoke as fast as desired since the smoke might be diluted by fresh air coming from the vent. Alternately, a slow response is possible in connection with duct smoke detectors where low airflow can result due to one or more filters of the respective detectors being clogged with dust.

While the thermistors 34 can be used to sense heat from developing fires, which provides an alternate form of sensing to the smoke sensing chamber 32, those thermistors can also be used to detect airflow at the respective detector.

Figure 4:
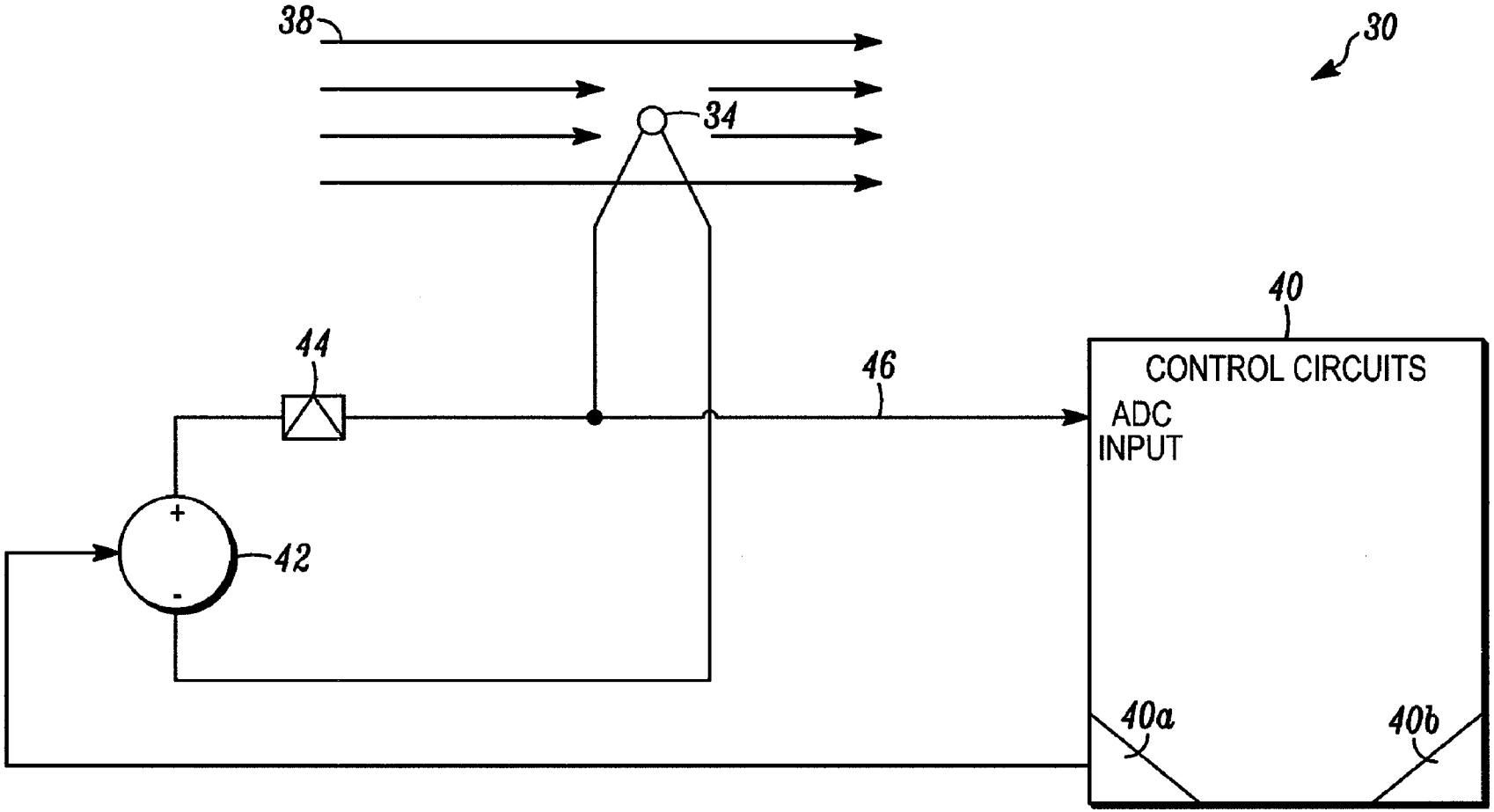
FIG. 4 is a schematic which illustrates other aspects of the detector of FIG. 3.

FIG. 4 illustrates aspects of circuitry of the detector 30 which can be coupled to the thermistor or thermistors 34. Such circuitry could include detector control circuits 40 which those of skill in the art will understand could be implemented, at least in part, by a programmable processor 40*a* and associated, executable control software 40*b*. The control software 40*b* can be recorded on a computer readable medium which is coupled to the processor 40*a*.

Control circuitry 40 is in turn coupled to a source, such as a voltage source 42 and a current control element 44. The current control element 44 can be in turn coupled to thermistor 44 as well as an input, see line 46, to the control circuits 40.

The source 42 can be used to couple electrical energy to the thermistor or thermistors 34 thereby raising their respective ambient temperature or temperatures. The amount that the respective temperature or temperatures increases is related to ambient airflow 38 by a known relationship. Output voltage, on the line 46, which can be processed in either analog or digital form via control circuits 40 indicates the temperature of the thermistor or thermistors 34. That temperature indicator is also related to airflow across the respective thermistor or thermistors. Where indicated airflow is either too low or too high the control circuitry 40 can indicate a need for maintenance or indicate a trouble condition via the medium 14 to the system control circuitry 18. The control unit 18 can in turn notify an operator that a respective member of the plurality 12 or 20 is indicating either low airflow or high airflow which can then be investigated and evaluated. Necessary maintenance functions can then be carried out relative to the respective detector or detectors.

It will be understood that the illustrative detector 30 could be implemented as either a duct smoke detector or a ceiling mountable smoke detector without departing from the spirit and scope of the present invention.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. A method comprising:

providing a fire detector having a plurality of environmental monitoring devices disposed in an ambient airflow proximate the fire detector;

acquiring a plurality of parameters indicative of the physical characteristics of a region; and providing the parameters as inputs to an alarm condition detection process, and, responsive thereto, adjusting sensitivities of at least some of the environmental monitoring devices; and sensing, automatically, an ambient condition of the region proximate the fire detector by at least one of the plurality of environmental monitoring devices of the fire detector and providing indicia indicative of the conditions as inputs to the alarm condition detection process, and, responsive thereto, adjusting a sensitivity of at least one other of the environmental monitoring devices of the fire detector.

2. A method as in claim 1 where acquiring includes acquiring regional floor plan information.

3. A method as in claim 1 where acquiring parameters includes acquiring at least some of, expected temperature in at least one portion of the region, indicia indicative of expected air flow in at least parts of the region, indicia indicative of space adjacent to an outside wall, indicia indicative of natural light in at least one part of the region, indicia of fuel load in the region, type of occupancy associated with the region, expected use of one or more portions of the region, or, indicia indicative of characteristics of environmental control of the region.

4. A method as in claim 1 where automatically sensing includes at least some of sensing air flow, sensing temperature at one or more locations in the region, sensing temperature differences at various heights in the region, sensing occupancy levels in the region, sensing dust levels in the region, sensing a gas level in the region, sensing levels of visible light in the region, sensing humidity levels in the region, sensing sound levels in the region, or, sensing usage of selected utility usage in the region.

5. A method as in claim 1 where adjusting includes adjusting alarm decision processing of a plurality of detectors installed in the region.

6. A method comprising:

providing a fire detector having a plurality of environmental monitoring devices disposed in an ambient airflow proximate the fire detector;

sensing, automatically, an ambient condition of a region proximate the fire detector at least partially via one of the plurality of environmental monitoring devices of the fire detector; and providing the indicia indicative of the conditions as inputs to an alarm condition detection process, and, responsive thereto, automatically adjusting a sensitivity of at least one other of the environmental monitoring devices of the fire detector.

7. A method as in claim 6 which includes acquiring a plurality of parameters indicative of the physical characteristics of the region.

8. A method as in claim 7 where acquiring parameters includes acquiring at least some of, expected temperature in at least one portion of the region, indicia indicative of expected air flow in at least parts of the region, indicia indicative of space adjacent to an outside wall, indicia indicative of natural light in at least one part of the region, indicia of fuel load in the region, type of occupancy associated with the region, expected use of one or more portions of the region, or, indicia indicative of characteristics of environmental control of the region.

9. A method as in claim 8 where automatically sensing includes at least some of sensing air flow, sensing temperature at one or more locations in the region, sensing temperature differences at various heights in the region, sensing occupancy levels in the region, sensing dust levels in the region, sensing a gas level in the region, sensing levels of visible light in the region, sensing humidity levels in the region, sensing sound levels in the region, sensing ambient air velocities at various locations in the region, or, sensing usage of selected utility usage in the region.

10. A method as in claim 9 where adjusting includes adjusting alarm decision processing of a plurality of detectors installed in the region.

11. A system comprising:

a fire sensor;

a plurality of ambient condition detectors located within the fire sensor and exposed to an ambient airflow proximate the detector; and control circuitry coupled to the fire sensor, the circuitry responding to at least some of manually entered regional parameters and automatically acquired parameters indicative of selected regional ambient conditions the automatically acquired parameters sensed by at least one of the plurality of ambient condition detectors and including software to adjust a sensitivity of at least one other of the environmental monitoring detectors of the fire detector in response thereto.

12. A system as in claim 11 where at least some of the detectors include flow circuitry that senses an ambient air flow rate.

13. A system as in claim 12 where the flow circuitry includes additional circuitry, responsive to a senses flow rate that generates an indicium indicative thereof.

14. A system as in claim 13 where the flow circuitry includes interface circuitry to couple the indicium to the control circuits.

15. A system as in claim 12 where the ambient condition detectors are coupled to the control circuitry by at least one of a wire or wireless medium and where the indicium is transmitted via the medium.

16. A system as in claim 12 wherein the fire sensor further comprises a housing, a smoke sensing chamber in the housing, at least one flow rate sensor of ambient air flow with local control circuits coupled thereto as well as local interface circuits to transmit flow rate indicating indicia to the control circuitry.

* * * * *